US005813208A

United States Patent [19]

Koltze

[11] Patent Number: 5,813,208

[45] Date of Patent: Sep. 29, 1998

[54] DEVICE FOR HOLDING AND RELEASING BOBBIN TUBES IN A POT SPINNING MACHINE

[75] Inventor: Karl Koltze, Mönchengladbach, Germany

[73] Assignee: W. Schlafhorst AG & Co., Moenchengladbach, Germany

[21] Appl. No.: 730,477

[22] Filed: Oct. 11, 1996

[30] Foreign Application Priority Data

Oct. 16, 1995 [DE] Germany ..... 195 38 411.3
Jul. 17, 1996 [DE] Germany ..... 196 28 717.0

[51] Int. Cl.[6] ..... D01H 1/08

[52] U.S. Cl. ..... 57/76; 57/275

[58] Field of Search ..... 57/266, 267, 76, 57/312, 274, 275, 281

[56] References Cited

U.S. PATENT DOCUMENTS

| | | | |
|---|---|---|---|
| 802,161 | 10/1905 | Gill | 57/312 |
| 874,662 | 12/1907 | De Vito | 57/312 |
| 3,030,761 | 4/1962 | Negishi | 57/312 |
| 3,462,934 | 8/1969 | Schulz et al. | 57/275 |
| 3,633,959 | 1/1972 | McCollough et al. | 57/275 X |
| 4,777,792 | 10/1988 | Marzoli | 57/267 X |
| 5,515,672 | 5/1996 | Koltze et al. | 57/281 |
| 5,588,602 | 12/1996 | Uno et al. | 57/266 X |

FOREIGN PATENT DOCUMENTS

| | | | |
|---|---|---|---|
| 19 56 035 B2 | 3/1978 | Germany . | |
| 43 40 031 A1 | 6/1994 | Germany . | |
| 43 24 039 A1 | 1/1995 | Germany . | |
| 22 49 840 B2 | 7/1996 | Germany . | |
| 2089846 | 6/1982 | United Kingdom | 57/267 |

*Primary Examiner*—Daniel P. Stodola
*Assistant Examiner*—Tina R. Taylor
*Attorney, Agent, or Firm*—Kennedy Covington Lobdell & Hickman, LLP

[57] ABSTRACT

A device for holding and releasing bobbin tubes in a pot spinning frame. A bobbin tube holding body has a longitudinal axis, an interior passage along the axis, and a lower end, with the lower end having an outer surface and being adapted to fit within a bobbin tube. A yarn guide for pot spinning is moveably mounted in the passage of the bobbin tube holding body for movement with respect to the bobbin tube holding body along a predetermined path aligned with the axis. A plurality of gripping elements are disposed at the lower end of the bobbin tube holding body concentrically with respect to the axis, and each of the gripping elements are moveable between an extended position extending radially outward of the outer surface of the lower end of the bobbin tube holding body for gripping engagement of the bobbin tube, and a retracted position radially inward of the outer surface out of gripping engagement with the bobbin tube. The gripping elements are moveable from each of their positions to their other position in response to movement of the yarn guide along its predetermined path.

13 Claims, 5 Drawing Sheets

DEVICE FOR HOLDING AND RELEASING BOBBIN TUBES IN A POT SPINNING MACHINE

FIELD OF THE INVENTION

The invention relates to a device for holding and changing bobbin tubes at the spinning stations of a pot spinning frame, wherein the yarn guides respectively dip from above into the spinning pots and the bobbin tubes are pushed over the yarn guides in the course of spinning and rewinding of the spinning cake, and wherein holding devices of the bobbin tubes, through which the yarn guides project, follow the traversing movements of the yarn guides, and wherein the bobbin tubes are respectively held on a gripping mechanism disposed on the holding devices.

BACKGROUND OF THE INVENTION

An automatic change of full spinning bobbins supporting rewound spinning cakes for empty bobbin tubes during pot spinning is known from German Patent Publication DE 43 24 039 A1. The full spinning bobbins are automatically placed on a support body with an arbor, and after they have been moved away, empty bobbin tubes which are received by a holder are brought in on supports of the same type. During spinning and during rewinding of the spinning cake on the bobbin tubes, the bobbin tubes are pushed over the yarn guide tube and held by the holding device. However, the holding device itself is not described.

Pot spinning devices are also known from U.S. Pat. Nos. 3,030,761 and 802,161, wherein the bobbin tubes are pushed over the yarn guide during spinning and during rewinding of the spinning cake on the bobbin tubes. In both cases the bobbin tubes are held by means of spring plates at the head end, wherein the respective spring plates engage a recess on the inner circumference of the bobbin tube.

From U.S. Pat. No. 3,030,761, it is known that the springs of the gripper mechanism for bobbin tubes are seated concentrically on the upper end of the yarn guide. If a fully wound bobbin tube, a spinning cop, is to be removed from the spinning pot, the yarn guide with the attached spinning cop is lifted and the yarn body is pushed against a ring-shaped bushing surrounding the yarn guide. By means of this the bobbin tube is pushed over the springs, which are compressed in the process, and stripped off the yarn guide. With this pot spinning device there is the danger that the yarn body can be damaged while the bobbin tube is stripped.

In the pot spinning frame described in U.S. Pat. No. 802,161, the springs for holding the bobbin tube are fastened on the yarn guide platform and also surround the yarn guide in the shape of a ring. If it is intended to change a spinning bobbin at a spinning station by means of this machine, the bobbin tube is pushed off the springs by means of a pivotable finger. The finger is manually actuated by depressing a lever connected with the finger. An actuating device for the finger for releasing the bobbin tubes from their holder is required at each spinning station with this pot spinning frame. This requires space and mechanical outlay. In the course of simultaneous release of very many spinning cops, such as is customary during doffing, a large exertion of force for actuating all fingers at the spinning stations would be required.

Because of the mentioned disadvantages, the devices shown in the mentioned U.S. patents are not suitable as a changing mechanism for simultaneously doffing spinning cops at all spinning stations of a pot spinning frame, in particular in connection with frames with an automated changing process.

A changing mechanism for spinning cops for the automatic doffing needs to be simple in construction, must be operable with the least possible expenditure of force, and must be effective without damage to the yarn body on the bobbin tube.

OBJECT AND SUMMARY OF THE INVENTION

It is the object of the instant invention to simplify the exchange of a spinning cop for an empty bobbin tube, following the rewinding of the spinning cake on the bobbin tube, in connection with pot spinning frames on whose spinning stations the empty bobbin tubes are pushed over the yarn guides during spinning.

In accordance with the present invention, a device for holding and releasing bobbin tubes in a pot spinning frame is provided. The holding and releasing device includes a bobbin tube holding body which has a longitudinal axis, an interior passage along the axis, and a lower end, with the lower end having an outer surface and being adapted to fit within a bobbin tube. A yarn guide for pot spinning is moveably mounted in the passage of the bobbin tube holding body for movement with respect to the bobbin tube holding body along a predetermined path aligned with the axis. A plurality of gripping elements are disposed at the lower end of the bobbin tube holding body concentrically with respect to the axis, and each of the gripping elements are moveable between an extended position extending radially outward of the outer surface of the lower end of the bobbin tube holding body for gripping engagement of the bobbin tube, and a retracted position radially inward of the outer surface out of gripping engagement with the bobbin tube. The gripping elements are moveable from each of their positions to their other position in response to movement of the yarn guide along its predetermined path.

It is advantageous to employ an actuating member moveably disposed intermediate the yarn guide and the gripping elements, with the actuating member being moveable in response to movement by the yarn guide along the predetermined path for actuation of movement of the gripping elements. The actuating member advantageously protects the gripping elements during the traversing movements of the yarn guide for building up the yarn layers of the spinning cake, and thereby prevents premature wear of the gripping elements from the continuous back and forth movement of the yarn guide.

The gripping elements may advantageously take the form of finger elements, and the finger elements may be in the form of resilient spring strips or resilient spring wires. The gripping elements may also advantageously be clamping bodies which are interconnected by a resilient member, and which have their radially inward movement limited by a cage member disposed on the lower end of the bobbin tube holding body. The gripping elements may advantageously be elastic tongue elements which are resiliently urged together toward the retracted position.

The holding and releasing device of the present invention is of simple construction and requires little space. Since no additional drive mechanisms are required, no additional energy sources are needed. Movements which are already required for the doffing process are efficiently employed to operate the device. The gripping elements require a small expenditure of force to grasp a bobbin tube and the bobbin tubes are securely held. A special alignment of the bobbin tubes for grasping them by means of the gripping elements is not necessary. The holding and releasing device cannot be affected by outside actions, for example by the operators.

Control devices for operating the holding and releasing device, as well as an energy supply, such as with pneumatic grippers, are not necessary.

DETAILED DESCRIPTION OF THE PREFERRED EMBODIMENTS

Figure 1A:
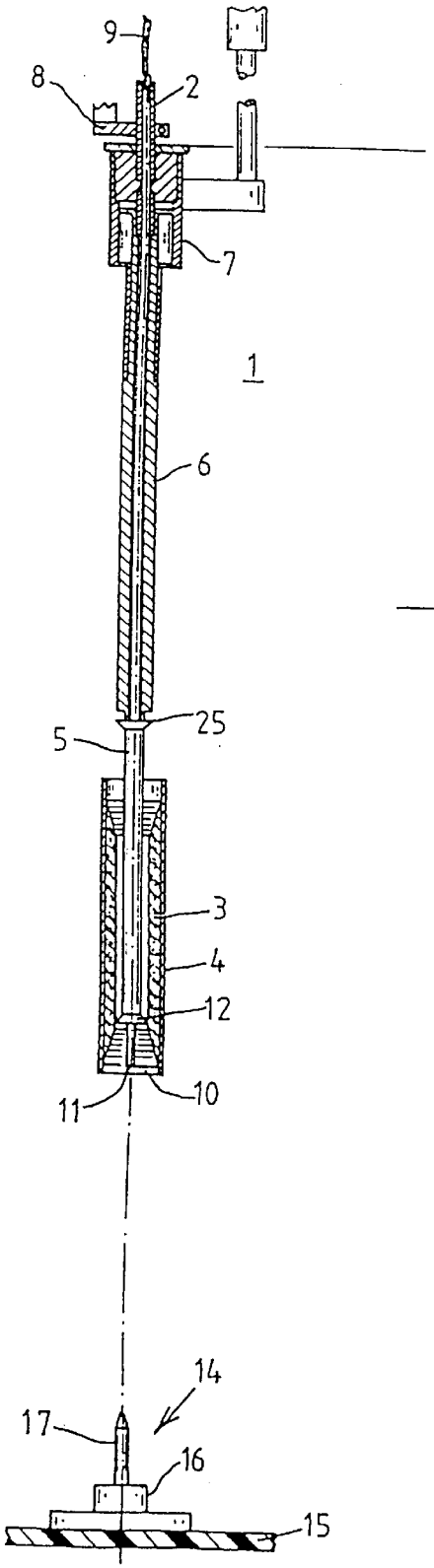
FIG. 1*a* is a schematic representation of a spinning station of a pot spinning frame during the spinning process.

A spinning station 1 of a pot spinning frame, not further shown here in detail, is schematically represented in FIG. 1*a*. Only the characteristics necessary for understanding the invention are shown and described.

In its lowest position during the spinning process, during the building of the spinning cake 3, the yarn guide tube 2 of the spinning station 1 stands on the inner wall of the rotating spinning pot 4. The drive and holding of the spinning pot 4 is not a subject of the invention and has therefore not been represented. An empty bobbin tube 5 has been pushed over the yarn guide tube 2. The bobbin tube 5 is held on a holding body 6 which, in turn, is supported by a doffing device 7 for bobbin tubes and bobbins, not shown in detail here. During spinning the doffing device 7 is coupled with the yarn guide platform 8 and also performs the traversing movement of the yarn guide 2. Sliver 9 is fed into the yarn guide tube from a drafting device, not represented here, and exits the mouth 11 of the yarn guide tube in the form of a yarn 10 in order to be deposited on the inner wall of the spinning pot 4. The mouth 11 of the yarn guide tube 2 projects out of the bobbin tube 5 during spinning.

To start rewinding of the spinning cake 3 on the bobbin tube 5, the holding body 6 moves the bobbin tube 5 past the mouth 11 of the yarn guide tube 2 which is in its lowest position, so that the bobbin tube 5 catches the yarn 10 with its lower edge 12. Once the spinning cop 13 (FIG. 1*b*) is completely wound, the spinning cop is placed on a conveyor system 14 by the doffing device 7. This can be, for example, a conveyor belt 15, on which support bodies 16 with respectively one arbor 17, on which the bobbin tubes 5 of the spinning cops 13 are placed, are transported.

Figure 1B:
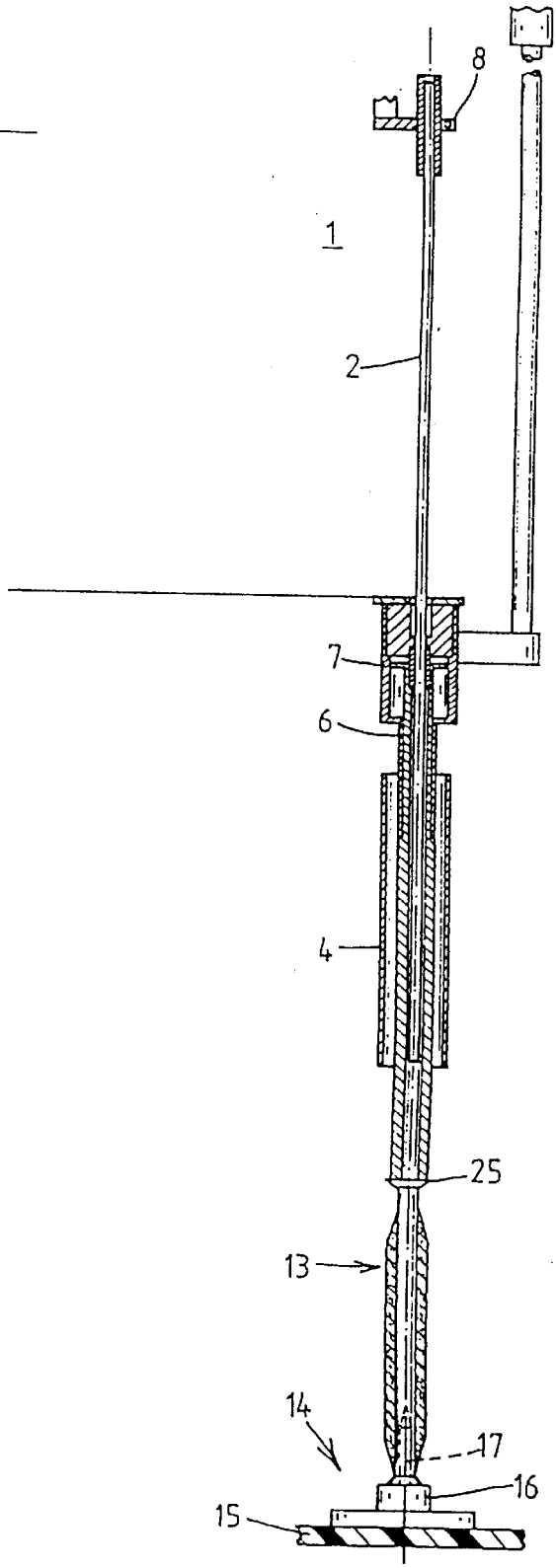
FIG. 1*b* is a view similar to FIG. 1 showing the spinning station during doffing of a finished, wound spinning cop onto a support body.

FIG. 1*b* shows the spinning station 1 during the doffing process. The doffing device 7 has placed the spinning cop 13 from the rewinding position in the spinning pot 4 onto the arbor 17 of a support body 16 on the conveyor belt 15. The yarn guide tube 2 has already been pulled out of the tube interior of the bobbin tube 5 and the bobbin tube has been disengaged from the holding body 6. Following lifting of the doffing device 7, the bobbin tube 5 is released, and the spinning cop 13 can be moved away by means of the conveying system 14 to make room for empty bobbin tubes needed for the subsequent spinning process.

Figure 2A:
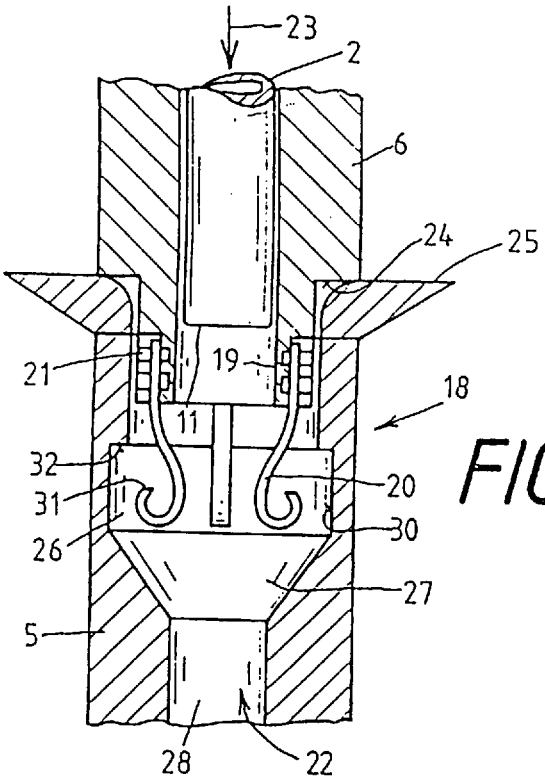
FIG. 2*a* is a schematic representation of the gripping elements of the bobbin tube holding and releasing device of the present invention in the retracted position.
Figure 2B:
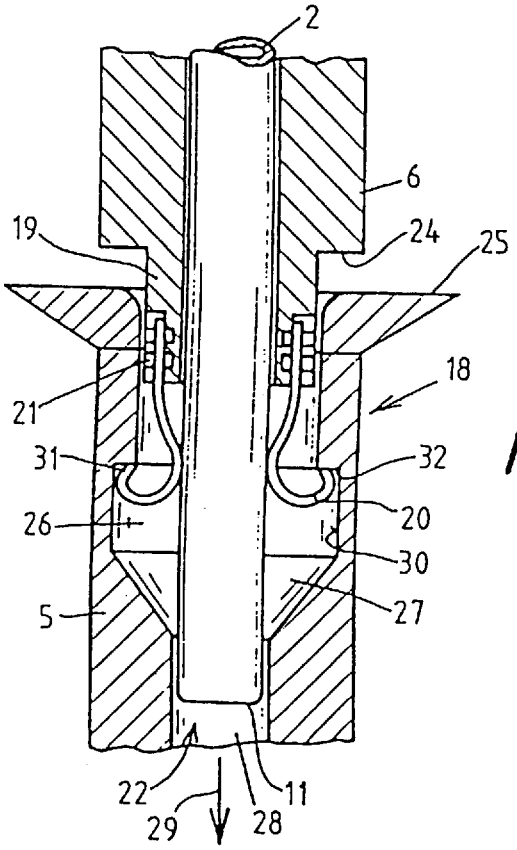
FIG. 2*b* is a schematic view showing the device of FIG. 2*a* in the extended position for gripping a bobbin tube.

Exemplary embodiments of the bobbin tube holding and releasing device in accordance with the invention are represented in the following Figures. A section through the lower end of the holding device 6 with a gripping device 18 being inserted into a bobbin tube 5 is shown in FIG. 2*a*. Gripping device 18 includes gripping elements in the form of fingers 20 which are mounted on a holding body 6. Fingers 20 are movable between a retracted position, shown in FIG. 2*a*, and an extended position, shown in FIG. 2*b*. In FIG. 2*b* it is also shown how the bobbin tube is suspended from the holding body 6 by the gripping device 18 during rewinding of the spinning cake onto the bobbin tube.

The holding body 6 consists of a tube having a passage in which yarn guide tube 2 is movably mounted, the passage extending along the longitudinal axis of holding body 6. At its lower end, the holding body 6 has an element 19 with a reduced circumference. This set-off element 19 has an outer surface with an outer diameter of such size that it can be inserted into the interior of a bobbin tube 5 without becoming jammed.

Fingers 20 of the gripping device 18 are disposed concentrically over the circumference of the set-off element 19. The fingers 20 are hook-shaped sheet metal strips or wires of an elastic material, for example spring steel. The fingers 20, which in the instant exemplary embodiment are evenly distributed on the circumference of set-off element 19, are fastened on the set-off element 19 with suitable fastening means 21, for example rivets, screws or spot welds. The fingers are bent in hook-shaped form and the hook eyes point outward. Because of the tension acting in them, in the retracted position the fingers 20 are retracted sufficiently far so that they do not extend radially past the outer circumference of the set-off element 19. Insertion of the gripping device 18 into the interior of the bobbin tube or its removal out of the bobbin tube interior 22 without problems is made possible by means of this arrangement.

Gripping or releasing a bobbin tube by the gripping device 18 is represented in FIG. 2*a*. For gripping a bobbin tube 5, the holding body 6 moves with its set-off element 19 with the gripping device 18 in the direction of the path shown by arrow 23 sufficiently far into the interior 22 of the bobbin tube 5 so that the stop face 24 of the portion of the holding body 6, which is not set off, rests on the upper bobbin tube edge 25. The fingers 20 are then in a cylinder-shaped recess 26 in the bobbin tube interior 22. A funnel-shaped area 27 extends below this recess 26, which makes a transition into the opening 28 for the yarn guide tube 2 and makes the insertion of the yarn guide tube 2 into the opening 28 easier.

When the yarn guide tube 2 is pushed along a path into the bobbin tube interior 22 and the opening 28, the mouth 11 of the yarn guide tube 2 pushes the fingers 20 apart to extend fingers 20 into the extended position radially outward of the outer circumference of set-off element 19. The fingers 20 come to rest against the inner wall 30 of the recess 26. When the holding body 6 is lifted and the yarn guide tube 2 is pushed past the lower bobbin tube edge for the spinning process, the tips 31 of the fingers 20 come to rest against the upper front face 32 of the recess 26. The tips of the fingers 20 are curved slightly inward so that they do not get hooked on the inner edge of the front face 32 when the gripping device 18 is lifted out of bobbin tube interior 22. The fingers 20 are flattened at their tops for better adherence on the front face 32.

Setting a bobbin tube or a wound bobbin tube, for example, a spinning cop 13, down takes place in the reversed sequence from the above described pick-up of a bobbin tube. In accordance with FIG. 2*b*, the doffing device 7 has placed the spinning cop 13 on the arbor 17 of a support body 16. To do this, the yarn guide tube 2 with the doffing device 7 was lowered sufficiently far so that the fingers 20 are kept spread out in the extended position by the yarn guide tube 2. Following placement of the spinning cop 13, the yarn guide tube 2 is drawn back into its lowest spinning position and releases the fingers 20. Because of their elasticity, the fingers 20 of the gripping device 18 return into the retracted position and release the bobbin tube 5 as represented in FIG. 2*a*.

Figure 3:
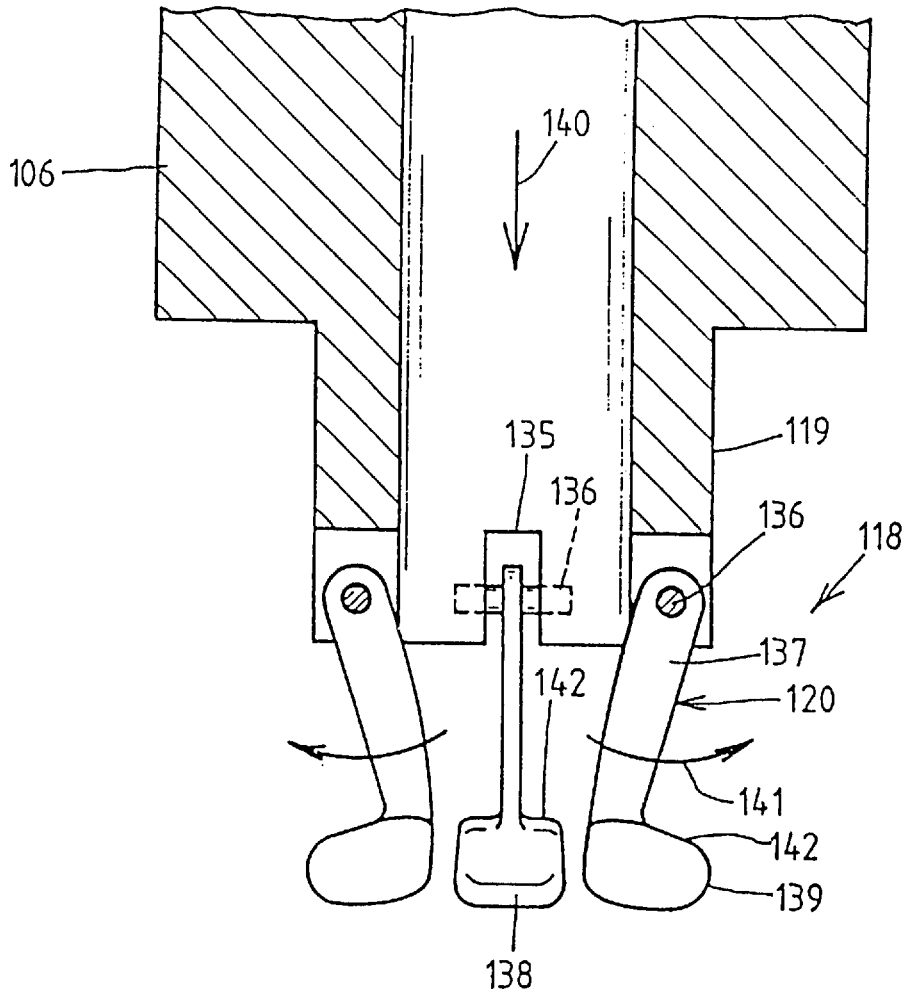
FIG. 3 is a schematic view of a further exemplary embodiment of the bobbin tube holding device of the present invention.

A further exemplary embodiment of the bobbin tube holding and releasing device of the present invention is represented in FIG. 3. A holding device 106 supports a gripping device 118, consisting of pivotable fingers 120, on its set-off element 119. In the instant exemplary embodiment four fingers 120 are disposed on the circumference of the set-off element 119. The fingers 120 have an L-shaped form. Four slits 135 have been milled into the circumference of the set-off element 119. Horizontally disposed shafts 136, from which the L-shaped fingers 120 are suspended, have been mounted in the walls forming the slits 135. The fingers 120 are seated on the upper ends of their vertical legs 137 and are rotatable around the shafts 136 and have pivot points at shafts 136. While the vertical leg 137 is flat, the lower leg 138 extending almost vertically in respect to it is widened. The widening has been selected to be such that, because of the weight of the lower leg 138 and the resulting center of gravity of finger 120, each finger 120 is urged by gravitational force toward the retracted position shown in FIG. 3. The center of gravity must be located such that the tip 139 of the lower leg does not project past the contour of the set-off element 119 in the retracted position, so that the insertion into and removal from the interior of a bobbin tube is possible without problems. Because the tips 139 of the lower legs are rounded, catching on edges is not possible.

When a yarn guide tube is pushed through the holding body 106 along the path shown by arrow 140, the fingers 120 are pivoted outward in the direction of the arrow 141 into the extended position. By means of this they can rest with the flattened tops 142 of the lower legs 138 against the front face of the recess in the bobbin tube interior and in this way support the bobbin tube.

If the yarn guide tube is drawn back and the fingers are released, they automatically swing back into the retracted position shown in FIG. 3 because of the weight of the lower legs 138 and the center of gravity of fingers 120 and release the bobbin tube.

Figure 4A:
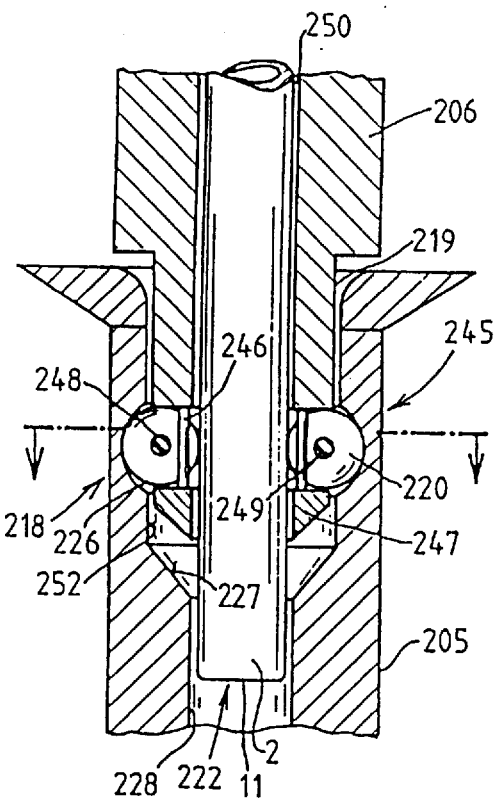
FIG. 4*a* is a longitudinal sectional view of a further exemplary embodiment of the bobbin tube holding device in the process of gripping a bobbin tube.
Figure 4B:
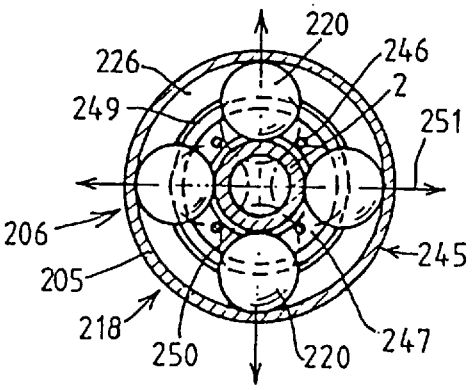
FIG. 4*b* is a cross-sectional view through the holding device of FIG. 4*a* in the area of the gripping elements taken along line 4*b*—4*b* of FIG. 4*a;*
Figure 4C:
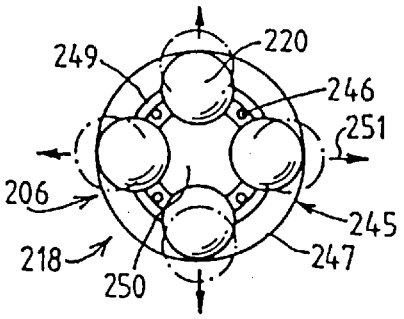
FIG. 4*c* is a view similar to FIG. 4*b* showing the holding device of FIG. 4*b* in detail with the gripping elements in the retracted position.

A still further exemplary embodiment of the bobbin tube holding and releasing device of the present invention is represented in FIGS. 4*a* to 4*c*. On its set-off element 219, a holding body 206 supports a gripping device 218 consisting of radially displaceable clamping bodies 220. In the instant exemplary embodiment, these radially displaceable clamping bodies are balls 220 held in a cage 245 in the set-off elements 219 of the holding body 206.

The cage 245 is formed by a conical ring 247, held away at a distance on the lower end 219 of the holding device 206 by bars 246, wherein the distance between this conical ring 247 and the lower end 219 of the holding body 206 is sufficiently large so that the balls 220 can freely move in this gap. The conical shaping of the ring is facing away from the balls and is used for inserting the holding body 206 into the bobbin tube interior 222 without problems. Each ball is drilled through. A resilient member, for example a rubber or elastic band 249, is pulled through this bore 248. The band 249 is endless and is pulled through all the balls 220 in the cage. In the instant exemplary embodiment there are four balls.

FIG. 4*b* shows a sectional view of the cage 245 taken along the section line 4*b*—4*b* represented in FIG. 4*a*. The balls 220 have been pushed by the yarn guide tube 2 radially outward in the direction of the arrow 251 out of the retracted position, indicated by dashes, into the extended position and into recess 226. The diameter of the recess 226 has been selected to be sufficiently large so that when the gripping device 218 is actuated, a clamping effect occurs between the balls 220 and the wall of the bobbin tube 205.

The gripping device 218 is shown in FIG. 4*c* in the retracted position as a detail from FIG. 4*b*. The elastic band 249 therefore pulls the balls into the position shown in FIG. 4*c*. Thus they extend into the passage 250 of the holding body 206 through which the yarn guide 2 is pushed.

When the yarn guide 2 is pushed through the passage 250, because of the elasticity of the band 249 the balls 220 move outwardly in the direction of the arrow 251 into the extended position illustrated by broken lines. The sphere-like shape of the balls 220 allows them to be easily moved outwardly with the mouth 11 of the yarn guide 2, requiring minimal force.

The gripping device is shown in the extended state in FIGS. 4*a* and 4*b*. The yarn guide 2 has been pushed through the passage 250 of the holding body 206 into the bobbin tube 205 and has therefore pushed the balls 220 in the radially outward direction 251 (FIG. 4*b*) into the recess 226 of the bobbin tube 205 adapted to the spherical shape. The recess 226 is a groove formed inside the bobbin tube 205. Following a short cylindrical piece 252 below the groove 226, into which the conical ring 247 of the holding body 206 dips, is a funnel-shaped area 227 which then terminates in the opening 228 for the yarn guide tube 2.

When the yarn guide tube 2 is lifted sufficiently far so that it releases the gripping device, the balls 220 are retracted radially inward out of the recess 226 by the elastic band 249 as far as the outer circumference of the set-off element 219 of the holding body 206. This retracted position is represented in FIG. 4*c*. The cage 245 prevents retraction of the balls 220 past the retracted position. The bobbin tube 205 is released by this retraction of the balls 220 and the holding body 206 can be pulled out of the bobbin tube interior 222.

Figures 5A, 5B:
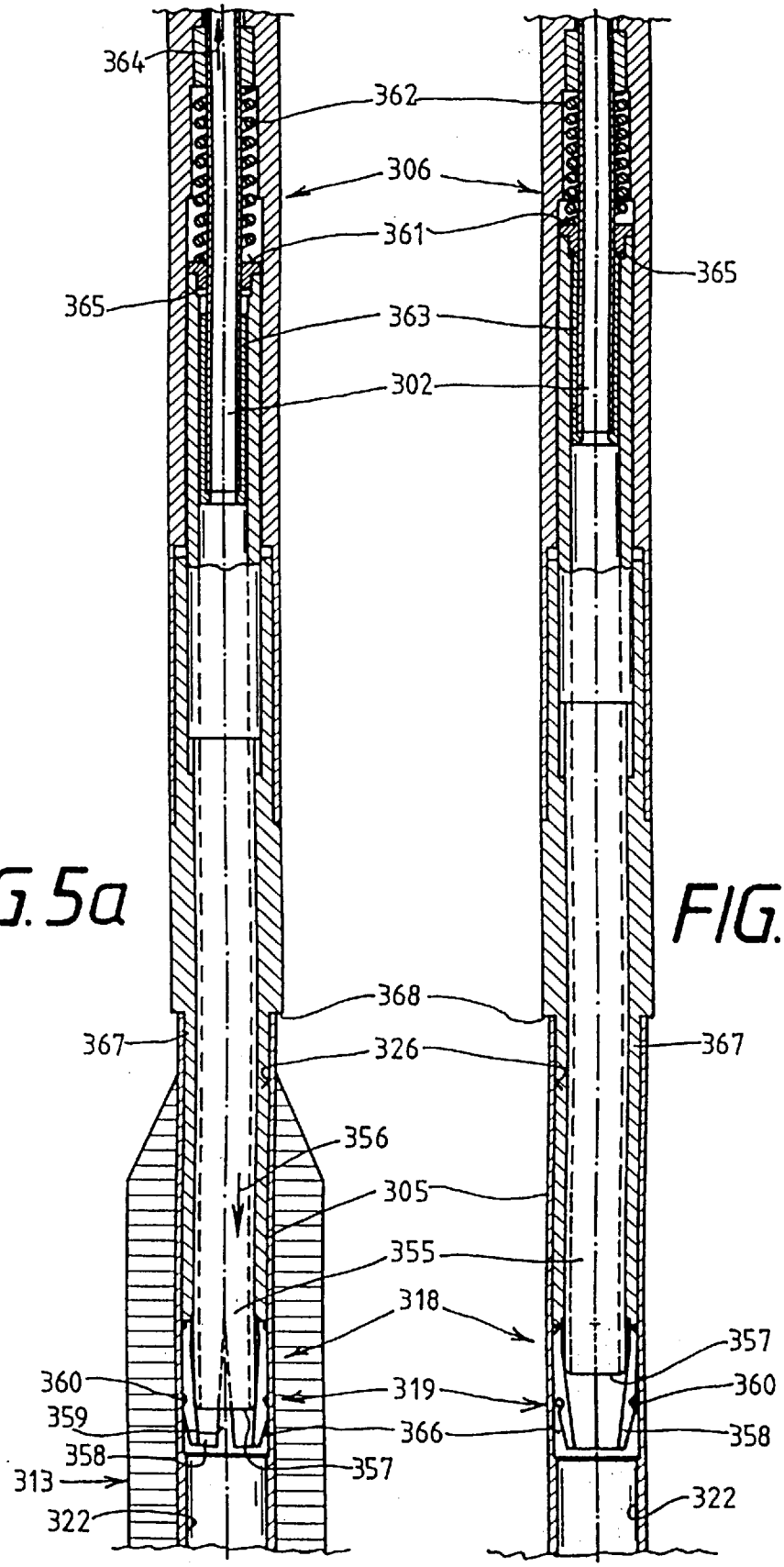
FIG. 5*a* is a longitudinal sectional view through a holding device with indirect actuation by the yarn guide with the gripping elements in the extended position for gripping a bobbin tube.
FIG. 5*b* is a longitudinal sectional view showing the holding device of FIG. 5*a* in the retracted position.

FIGS. 5*a* and 5*b* show an exemplary embodiment of a bobbin tube holding and releasing device of the present invention which is indirectly actuated by the yarn guide 302. The holding body 306 is shown, on whose gripping device 318 a bobbin tube 305 already wound with the rewound spinning cake, a spinning bobbin 313, is suspended. As in the previous exemplary embodiments, the holding body 306 also concentrically encloses the yarn guide 302. However, in contrast to the preceding exemplary embodiments, an auxiliary actuating member, which is in operative connection with the yarn guide 302, is located between the holding body 306 and the yarn guide 302 and actuates the gripping device 318. In the instant exemplary embodiment the actuating member is embodied as a tube 355 which is displaceably seated in the holding body 306 and through which the yarn guide 302 can penetrate in its entire length. If the actuating tube 355 is displaced downward along the path indicated by the arrow 356, it actuates the gripping device 218 with its front end 357.

In the instant example, the gripping device 318 consists of elastic tongue elements 358 which can constitute the lower end 319 of the holding device 306 itself. In the retracted position, the tongues 358, which are separated from each other by V-shaped slits 359, are bent inward and resiliently urged together by the elastic material which forms the tongues 358, as can be seen in FIG. 5*b*. In the course of its downward movement, the front end 357 of the actuating tube 355 pushes the tongues 358 radially outward into the extended position, so that they come to rest against the inner circumferential surface 322 of the bobbin tube 305. By means of this the bobbin tube 305 is supported by frictional connection with the holding body 306. The tongues 358 can be enclosed by a resilient member in the form of an elastic ring 360 of a material with a high coefficient of friction, for example rubber, which on the one hand aids the holding of the bobbin tube 305 and, on the other hand, assists retraction of the tongues 358.

The actuating tube 355 is supported on its upper front end 361 on a spring 362 which in turn is supported on the holding body 306. The spring 362 surrounds the yarn guide 302. The spring 362 presses the actuating tube 355 along the path shown by arrow 356 into position for actuating the gripping device 318, so that the tongues 358 are extended outward into the extended position for holding a bobbin tube 305.

In the instant exemplary embodiment the yarn guide 302 differs from the yarn guide in the previous exemplary embodiments in that it is not a completely smooth tube, but has a collar 363 on its lower end. When the actuating tube 355 actuates the gripping device 318, the yarn guide 302 can be pushed out of the holding body 306 and the spinning process can be performed.

The actuating tube 355 protects the yarn guide 302 during its traversing movements for building up the yarn layers of the spinning cake corresponding to a ring spinning cop from continuous contact with the gripping device 318 of the stationary holding body 306 and therefore from premature wear. During a spinning bobbin change the yarn guide here has the function of lifting the actuating tube, by means of which the bobbin tube is released, and to release the actuating tube during lowering into the spinning position, so that the gripping device operates to grip a bobbin tube.

The following takes place when exchanging a full spinning bobbin 313 for an empty bobbin tube 305: The yarn guide 302 is retracted into the actuating tube 355 in the direction of the path shown by arrow 364. While being pulled up, its collar 363 comes into contact with a shoulder 365, located on the inside of the actuating tube 355. Then the yarn guide 302 is further pulled up along the path shown by the arrow 364 until the actuating tube 355 releases the gripping device 318 into the retracted position. In the process the spring 362 is pre-stressed by compression. This state is represented in FIG. 5*b*. When the elastic tongues 358 have receded into the retracted position, the holding body 306 can be pulled out of the bobbin tube 305.

The grasping of an empty bobbin tube begins by first positioning an empty bobbin tube at the spinning station by means of a suitable conveyor system, not shown here. The holding body 306 is lowered and with tongues 358, which are in the retracted position, is inserted into the interior of a bobbin tube. Insertion of the holding body 30 into a bobbin tube is made easier by means of a conical tapering 366 of the tongues 358 at the end of the holding body 306. In the instant exemplary embodiment the bobbin tube 305 has a recess 326, into which the holding body 306 is inserted with its gripping device 318. The lower portion 367 of the holding body 306 has such a diameter that it can easily be inserted into and removed from the recess 326. The holding body 306 is inserted into the bobbin tube until the bobbin tube 305 contacts a shoulder 368 of the holding body. The lower portion 367 of the holding body 306 which is received into the bobbin provides the required positional stability during the spinning process.

After the holding body 306 has been inserted into the bobbin tube 305, the yarn guide 302 is lowered from its highest position, shown in FIG. 5*b*, along a path in the direction toward the bobbin. In the process the spring 362 relaxes and, while supported by the upper front face 361 of the actuating tube 355, pushes the actuating tube in the direction of the arrow 356 (FIG. 5*a*) into the gripping device 318, because of which the tongues 358 are extended and pressed against the bobbin tube interior 322. The bobbin tube 305 is held on the holding body 306 in this way.

The employment of an actuating member for the indirect actuation of the gripping elements is not limited to the instant exemplary embodiment. The employment of an actuating member is also conceivable for actuating the gripping elements of the previous exemplary embodiments.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for holding and releasing bobbin tubes on a pot spinning station having a yarn guide, said device comprising:

a bobbin tube holding body having a longitudinal axis, an interior passage along said axis, and a lower end;

said lower end having an outer surface and being adapted to fit within a bobbin tube;

said yarn guide being moveably mounted in said passage of said bobbin holding body for movement with respect to said bobbin holding body along a predetermined path aligned with said axis;

a plurality of gripping elements disposed at said lower end concentrically with respect to said axis, each of said gripping elements being moveable between an extended position extending radially outward of said outer surface of said lower end for gripping engagement of said bobbin tube, and a retracted position radially inward of said outer surface out of gripping engagement with said bobbin tube; and said gripping elements being movable from each of said positions to the other said position in response to movement of said yarn guide along said path, whereby gripping of said bobbin tube by said gripping elements will be engaged and released by movement of said yarn guide.

2. The bobbin tube holding and releasing device of claim 1, wherein said yarn guide is moveable to contact said gripping elements to cause said gripping elements to move to said extended position.

3. The bobbin tube holding and releasing device of claim 1, further including an actuating member moveably disposed intermediate said yarn guide and said gripping elements, said actuating member being moveable in response to movement by said yarn guide along said path for actuation of said movement of said gripping elements.

4. The bobbin tube holding and releasing device of claim 1, wherein each of said gripping elements comprises a finger element.

5. The bobbin tube holding and releasing device of claim 4, wherein each of said finger elements comprises a resilient spring strip.

6. The bobbin tube holding and releasing device of claim 4, wherein each of said finger elements comprises a resilient spring wire.

7. The bobbin tube holding and releasing device of claim 4, wherein said longitudinal axis is oriented vertically, and each of said finger elements is pivotally mounted on said lower end and has a pivot point and a center of gravity, said center of gravity and said pivot point being oriented so that said finger element is urged by gravitational force toward said retracted position.

8. The bobbin tube holding and releasing device of claim 1, further including a resilient member for resiliently urging said gripping elements toward said retracted position.

9. The bobbin tube holding and releasing device of claim 1, wherein each of said gripping elements comprises a clamping body.

10. The bobbin tube holding and releasing device of claim 9, wherein said yarn guide is moveable to contact said clamping bodies to cause said clamping bodies to move to said extended position.

11. The bobbin tube holding and releasing device of claim 10, and further including a resilient member interconnecting said clamping bodies and urging said clamping bodies toward said retracted position, said clamping bodies being displaceable from said extended position to said retraced position by said urging of said resilient member during movement of said yarn guide out of contact with said clamping bodies.

12. The bobbin tube holding and releasing device of claim 11, wherein said each of said clamping bodies comprises a ball, and further including a cage member disposed on said lower end adjacent said balls to limit radially inward displacement of said balls beyond said retracted position.

13. The bobbin tube holding and releasing device of claim 12, wherein said gripping elements are elastic tongue elements resiliently urged together toward said retracted position, said yarn guide is moveable along a portion of said path to cause said elastic tongues to move to said extended position, and said tongues are displaceable from said extended position to said retraced position by said resilient urging during movement of said yarn guide along another portion of said path.

* * * * *